US006802585B1

(12) United States Patent
Wratchford

(10) Patent No.: US 6,802,585 B1
(45) Date of Patent: Oct. 12, 2004

(54) PRINT HEAD INK TEMPERATURE CONTROL DEVICE

(75) Inventor: Philip D. Wratchford, Waterloo, IL (US)

(73) Assignee: Videojet Systems International, Inc., Wood Dale, IL (US)

( * ) Notice: Subject to any disclaimer, the term of this patent is extended or adjusted under 35 U.S.C. 154(b) by 0 days.

(21) Appl. No.: 09/389,904

(22) Filed: Sep. 3, 1999

(51) Int. Cl.[7] ..... B41J 29/38
(52) U.S. Cl. ..... 347/17
(58) Field of Search ..... 347/5, 14, 17, 347/54, 68–72

(56) References Cited

U.S. PATENT DOCUMENTS

| | | | | | |
|---|---|---|---|---|---|
| 4,716,279 | A | * | 12/1987 | Hori et al. | 219/541 |
| 4,901,093 | A | | 2/1990 | Ruggiero et al. | 347/48 |
| 5,015,986 | A | | 5/1991 | Uchida et al. | 338/22 R |
| 5,086,308 | A | | 2/1992 | Takahashi et al. | 347/68 |
| 5,182,578 | A | * | 1/1993 | Goepel et al. | 346/140 R |
| 5,227,813 | A | | 7/1993 | Pies et al. | 347/72 |
| 5,623,292 | A | | 4/1997 | Shrivastava et al. | 347/18 |
| 5,635,964 | A | * | 6/1997 | Burr et al. | 347/17 |
| 5,666,140 | A | * | 9/1997 | Mitani et al. | 347/12 |
| 5,784,089 | A | | 7/1998 | Crawford | 347/88 |
| 6,371,598 | B1 | * | 4/2002 | Fujii et al. | 347/54 |

FOREIGN PATENT DOCUMENTS

| | | | | | |
|---|---|---|---|---|---|
| JP | 02 194960 | A | | 8/1980 | |
| JP | 58053176 | A | | 3/1983 | |
| JP | 59 109370 | A | | 6/1984 | |
| JP | 59109370 | A1 | * | 6/1984 | 347/17 |
| JP | 01 110963 | A | | 4/1989 | |
| JP | 01213978 | A | | 8/1989 | |
| JP | 01 229639 | A | | 9/1989 | |
| JP | 01299045 | A | | 12/1989 | |
| JP | 03272854 | A | * | 12/1991 | 347/17 |
| JP | 04 152147 | A | | 5/1992 | |
| JP | 04336256 | A | | 11/1992 | |
| JP | 404336256 | A | * | 11/1992 | 347/68 |
| JP | 04345852 | A | | 12/1992 | |
| JP | 05082304 | A | | 4/1993 | |
| JP | 07220860 | A | | 8/1995 | |
| JP | 10138468 | A | | 11/1996 | |

OTHER PUBLICATIONS

PCT International Search Reported Dated Jun. 6, 2001.

* cited by examiner

*Primary Examiner*—Stephen D. Meler
*Assistant Examiner*—An H. Do
(74) *Attorney, Agent, or Firm*—Piper Rudnick LLP

(57) ABSTRACT

An ink jet print head is provided and includes a top body portion, an intermediate body portion having an upper side and a lower side, a plurality of ink channels disposed in a common plane along the upper side, each of said channels having at least one orifice for projecting ink towards a substrate, the, upper side of the intermediate body portion located adjacent the top body portion, a main body portion located adjacent the lower side of the intermediate body portion; and an ink heater made of a thermistor material, the ink heater having a substantially planar configuration and is located between the lower side of the intermediate body portion and the main body portion, and extends in a plane parallel to the plane of the channels and adjacent thereto.

In the preferred embodiment, the ink heater is designed to compensate for an ink jet print head having certain channels which dissipate heat at a higher rate than other ink channels. In particular, the ink heater includes electrodes formed on the PTC thermistor material in an arrangement or pattern which compensates for the varying heat dissipation of the ink channels.

28 Claims, 8 Drawing Sheets

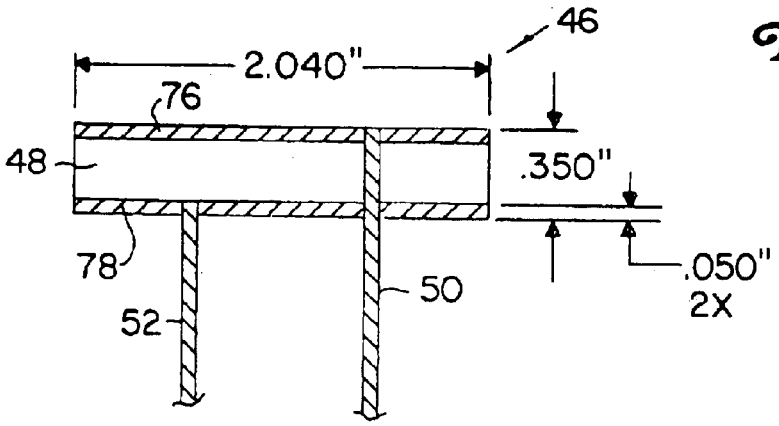
Fig. 7A
Fig. 7B
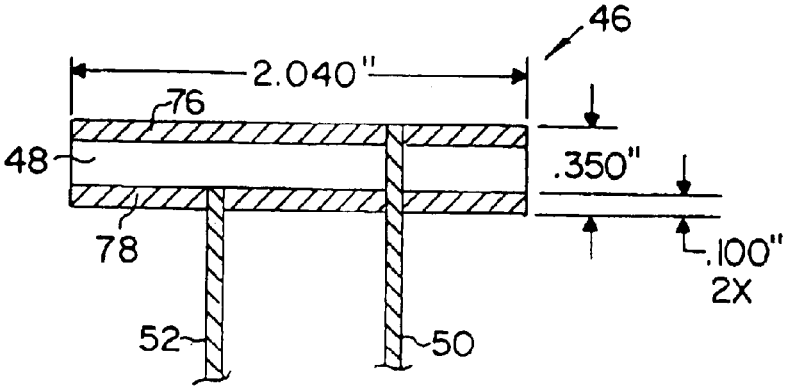
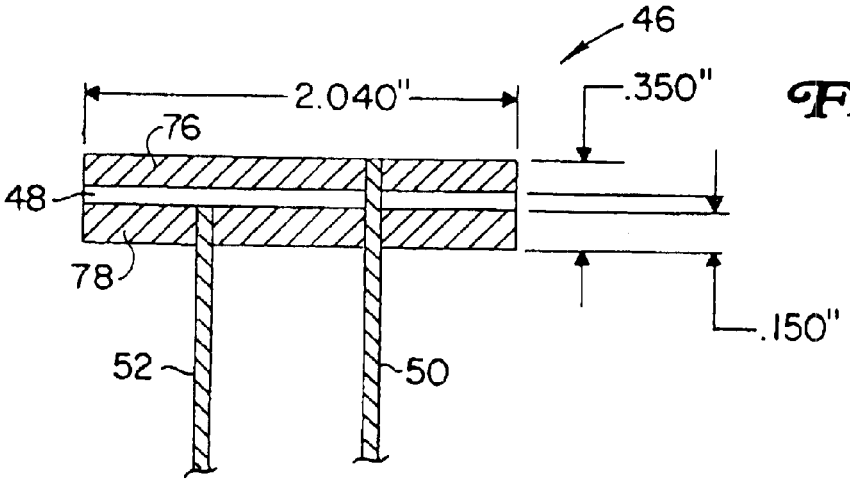
Fig. 7C

PRINT HEAD INK TEMPERATURE CONTROL DEVICE

BACKGROUND OF THE INVENTION

The invention relates, generally, to ink jet printers and, more particularly, to an improved print head ink temperature control device.

The prior art systems include drop-on-demand and continuous jet systems. In many cases, such systems use specially formulated inks for quick drying, clear marking and other characteristics which are desired by the user. These inks are temperature sensitive and therefore variation in ambient temperatures, such as in factories where products to be marked are being manufactured, adversely affect printing. Ink jet printing systems frequently locate the electronics and ink supplies remotely from the point where products are to be marked by the ink drops. The ink jet printhead including the nozzle is located at the point of marking and may be connected to a cabinet by a relatively long (½ to thirty foot) umbilical-like tube which supplies both ink and electrical control signals to the printhead assembly.

It is somewhat difficult to maintain the ink at the optimum temperatures desired for best printing. For example, many ink jet systems are rated for use in environments within the temperature range of 40° and 120° Fahrenheit. Many inks, however, optimally operate within a temperature range of as little as plus or minus five degrees. For example, an ink formulated for use at 75° is desirably maintained between 70° and 80° F. during printing operations. For this reason, control of the temperature of ink used in ink jet printing systems are known to be beneficial.

U.S. Pat. No. 5,623,292 is assigned to the instant assignee and discloses a temperature controller for an ink jet printer. However, the temperature controller requires a temperature sensor and a control circuit. The temperature sensor and control circuit are potential failure items and increase the cost and manufacturing complexity.

Japanese Published Patent Application JP 04336256A discloses a positive temperature coefficient (PTC) heater used to heat ink in channels of a printhead. However, the design is somewhat complicated in that a plurality of PTC heaters are used and each PTC heater has an electrode on opposing sides of the heater. Japanese Published Patent Application JP 58053176A discloses a PTC thermistor for heating fluids and which has mutually isolated side electrodes to permit bi-directional current flow.

The use of PTC thermistor's are also shown in, for example, U.S. Pat. Nos. 5,015,986, 5,086,308 and 5,784,089 and Japanese Published Application JP 04345852A.

It is desired to provide a printhead of an ink jet printer having a heater which can maintain ink temperature within a predetermined, acceptable range of temperatures.

It is further desired to provide such a printhead heater which maintains the temperature of ink in the multiple channels or chambers at a uniform temperature.

It is further desired to provide an ink heater which compensates for a printhead having some ink channels which dissipate heat at a rate different than the other ink channels.

It is still a further feature of the invention to provide a printhead having an ink heater which is less costly to manufacture and has an improved life span.

SUMMARY OF THE INVENTION

The present invention provides an ink jet print head, comprising, a plurality of ink channels disposed in a common plane, each of said channels having at least one orifice for projecting ink towards a substrate, and an ink heater made of a thermistor material, the ink heater having a substantially planar configuration and extending in a plane parallel to the plane of the channels and adjacent thereto.

The present invention also provides an ink jet print head comprising, a top body portion, an intermediate body having an upper side and a lower side, a plurality of ink channels disposed in a common plane along the upper side, each of said channels having at least one orifice for projecting ink towards a substrate, the upper side of the intermediate body portion located adjacent the top body portion, a main body portion located adjacent the lower side of the intermediate body portion, and an ink heater of a thermistor material, the ink heater having a substantially planar configuration and is located between the lower side of the intermediate body portion and the main body portion, and extends in a plane parallel to the plane of the channels and adjacent thereto.

In a preferred embodiment, the ink heater is designed to compensate for an ink jet print head having certain ink channels which dissipate heat at a higher rate than other ink channels. In particular, the ink heater includes electrodes formed on the PTC thermistor material in an arrangement or pattern which compensates for the varying heat dissipation of the ink channels.

BRIEF DESCRIPTION OF THE DRAWINGS

FIGS. 7A–7H show various configurations of the first and second electrodes on the thermistor material of the ink heater, in accordance with the present invention.

DETAILED DESCRIPTION OF THE INVENTION

Figure 1:
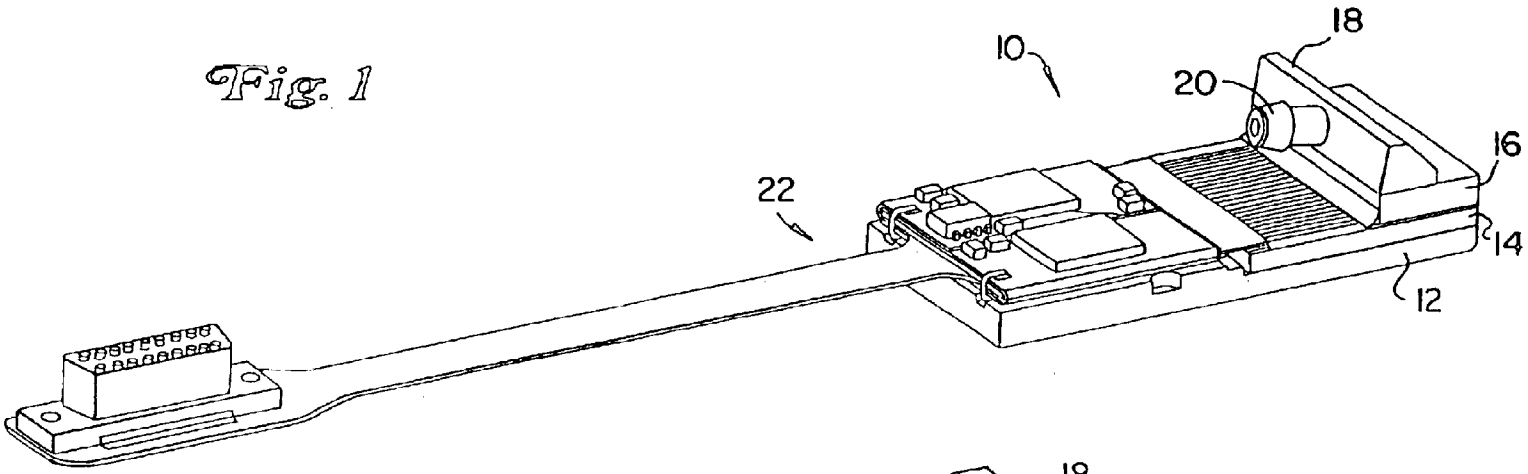
FIG. 1 is a perspective view of an ink jet, including a flex-circuit with a connector, in accordance with the present invention.
Figure 2:
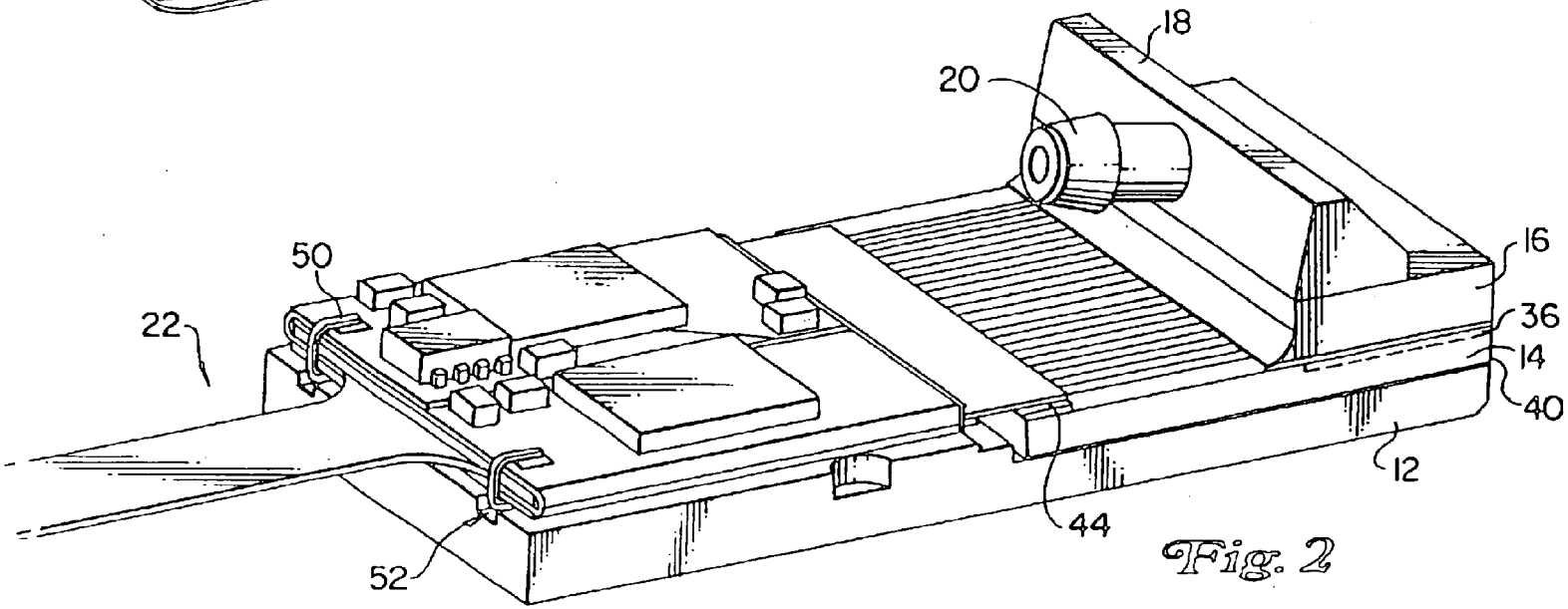
FIG. 2 is an enlarged view of the print head of FIG. 1

FIGS. 1 and 2 show a printhead 10 for an ink jet printer in accordance with the present invention. The printhead 10 includes a main body portion 12, intermediate body portion 14, and top body portion 16. An ink manifold 18 is shown to include an external ink conduit 20 which receives the ink from an ink supply (not shown). The printhead 10 includes a control flex-circuit 22.

Figure 3:
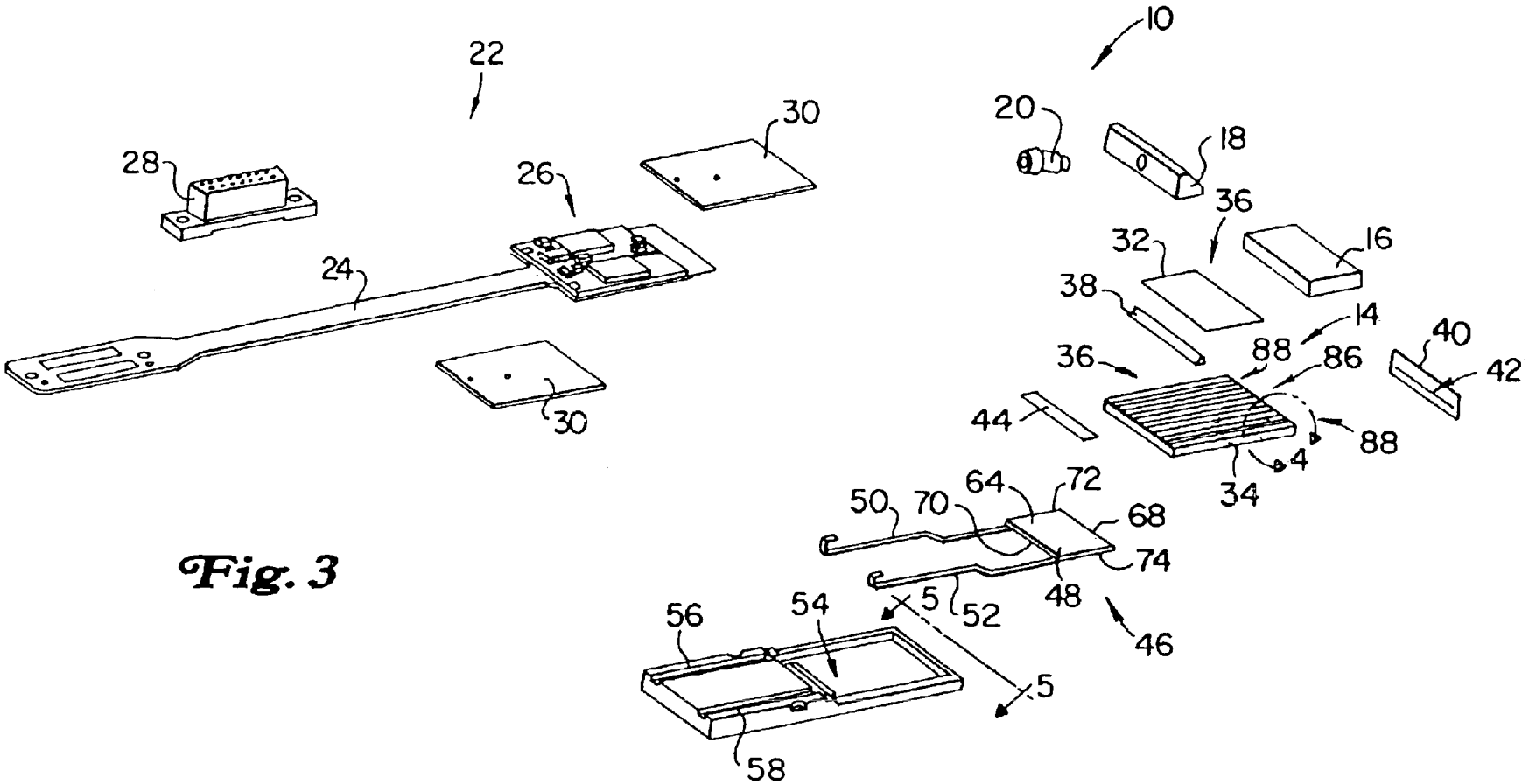
FIG. 3 is an exploded view of the print head of FIG. 1.
Figure 4:
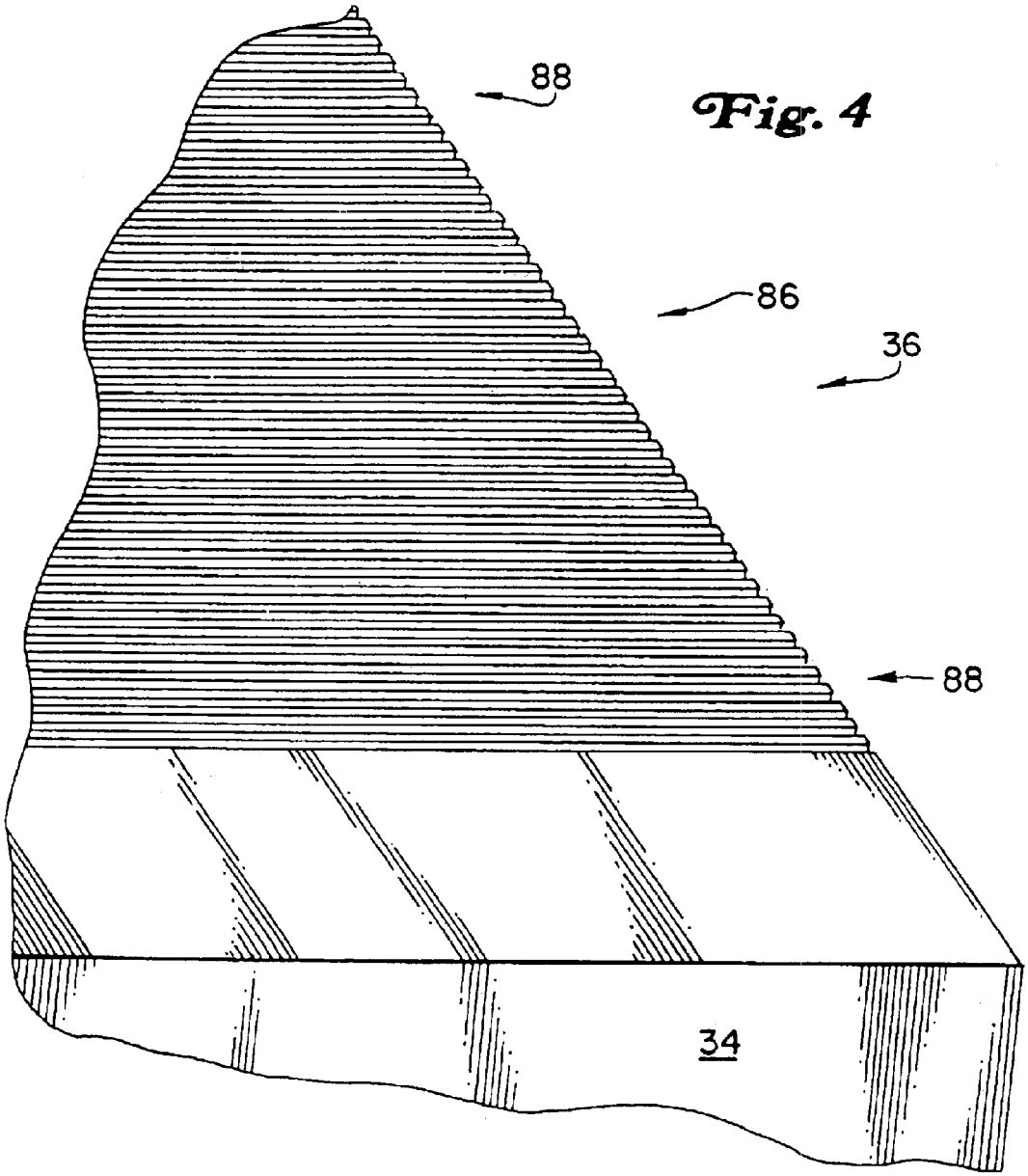
FIG. 4 is an enlarged view of detail A from FIG. 3, showing the ink channels.

FIG. 3 shows an exploded view of the printhead 10 of FIG. 1. The control flex-circuit 22 includes a flex-circuit 24, components 26, connector 28 and a pair of plates 30 which provide rigidity to the flex-circuit 24 in the area of the components 26. It can be seen from FIG. 3 that the intermediate portion 14 includes a first piezo electric member 32 which is secured to a second piezo electric member 34 via an electrically conductive adhesive (not shown). FIG. 4 shows an enlarged view of a detail A from FIG. 3, showing a plurality of ink channels 36 in the second piezo electric member 34. The ink channels 36 extend upwardly and through the first piezo electric member 32. A back seal 38 is used to hydraulically seal the intermediate body portion 14 and top body portion 16. A plate 40 includes a plurality of orifices 42. The plate 40 is secured to the intermediate body portion 14 with the orifices 42 aligned with respective ink channels 36. An electrically conductive adhesive 44 is used to electrically couple the control flex-circuit 22 to the intermediate body portion 14. The ink manifold 18 delivers the ink to the ink channels 36 via the top body portion 16. An ink heater 46 includes a PTC thermistor portion 48 and a first lead 50 and second lead 52. The main body portion 12 is shown to include a recess 54 and first lead groove 56 and second lead groove 58.

Figure 5:
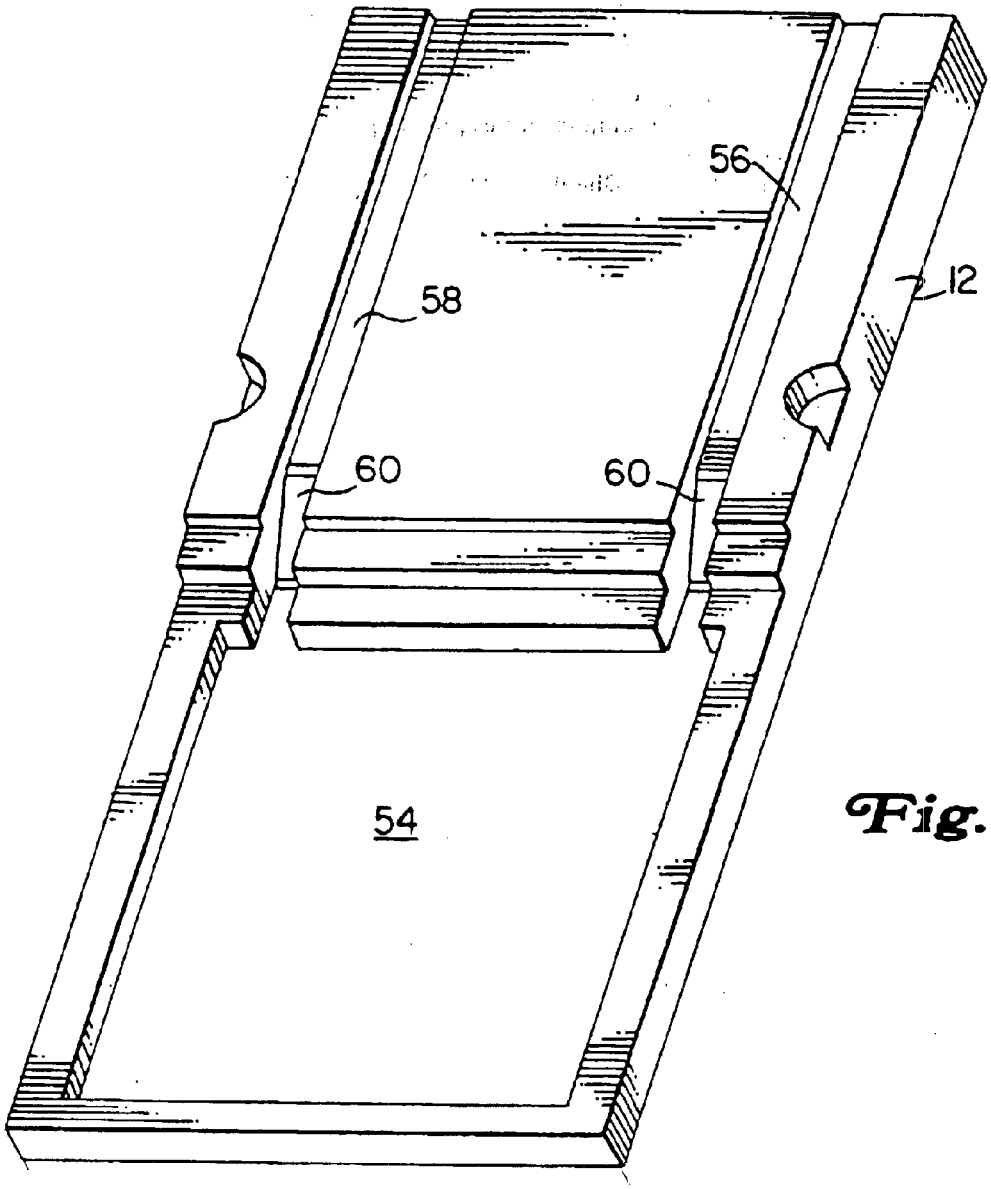
FIG. 5 is a view of the main body portion of the print head taken along line 5—5 of FIG. 3.

FIG. 5 is a view of the main body portion 12 taken along line 5—5 of FIG. 3 and more clearly shows the recess 54 and first lead groove 56 and second lead groove 58. It can be seen that the first and second lead grooves 56, 58 extend into the recess 54 at inclined portions 60. The recess 54 receives the PTC thermistor portion 48 and the first and second lead grooves 56, 58 receive the first and second leads 50, 52 respectively.

Figure 6:
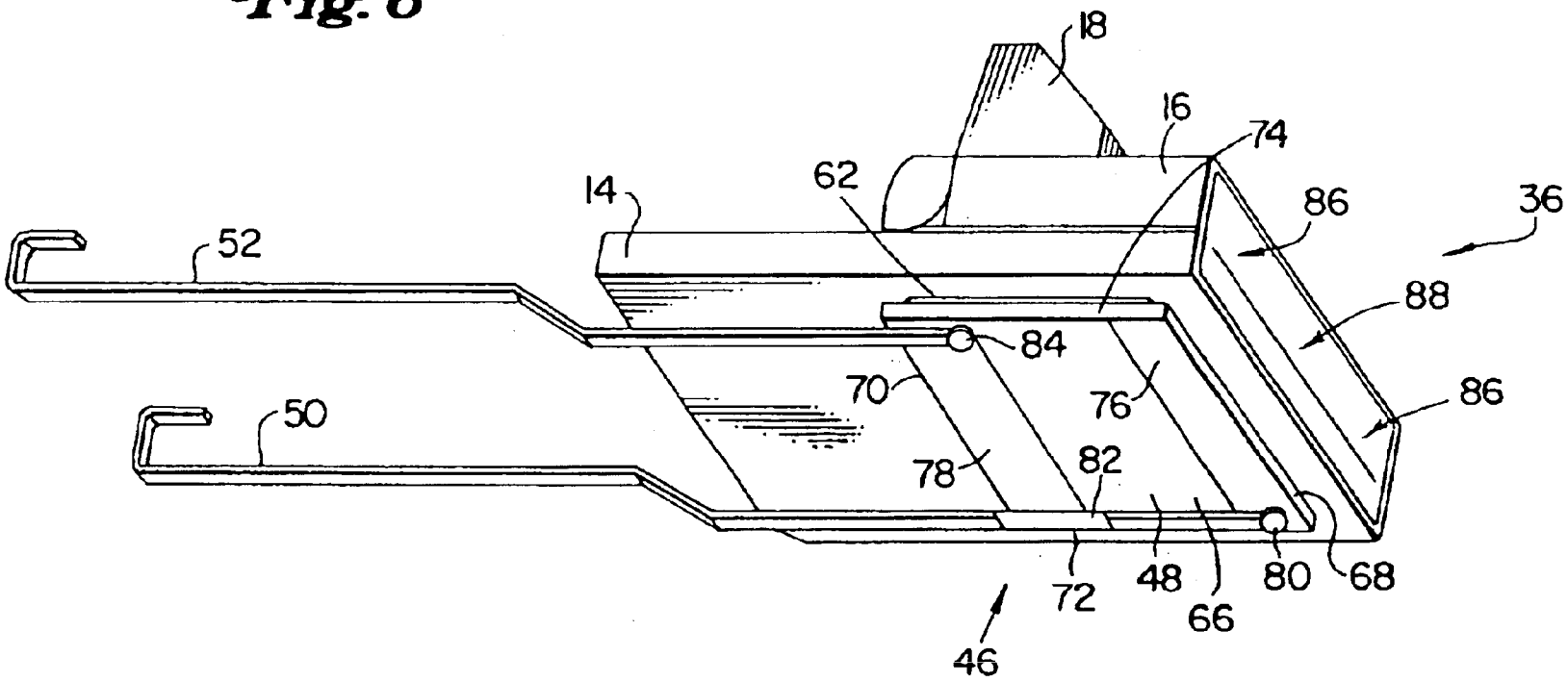
FIG. 6 is a perspective view of the ink heater of the present invention secured to the intermediate and top body portions.

As can be seen from FIG. 6, the PTC thermistor portion 48 is secured to the intermediate body portion 14 via thermally conductive adhesive 62. As such, the PTC thermistor portion 48 extends across the width of the intermediate body portion 14. With the PTC thermistor portion 48 secured in this manner, the heat generated by the ink heater 46 is more uniformly distributed to the ink channels or chambers 36. It should be noted that FIG. 4 discloses ink channels 36. However, the present invention applies equally as well to printheads such as the type disclosed in U.S. Pat. No. 4,901,093 wherein ink chambers are provided that hold ink behind the orifice so that ink drops are ejected from the orifice when longitudinally moving transducers apply pressure to the ink in the channels. The terms "ink channels" and "ink chambers" are used interchangeably herein and are intended to cover both embodiments.

FIGS. 3 and 6 show that the PTC thermistor portion 48 includes an upper side 64 and a lower side 66. FIG. 6 shows that the PTC thermistor portion 48 includes a first longitudinal edge 68, second longitudinal edge 70, first transverse edge 72 and second transverse edge 74. The lower side 66 of the PTC thermistor portion 48 includes a first electrode 76 which extends adjacent to the first longitudinal edge 68, and a second electrode 78 which extends adjacent to the second longitudinal edge 70. The first lead 50 is electrically coupled and secured to the first electrode 76 via a solder bump 80. Insulator 82 is provided to insulate the first lead 50 from the second electrode 78. The second lead 52 is electrically coupled and secured to the second electrode 78 via a solder bump 84.

FIG. 2 shows that the first and second leads 50, 52 are coupled to the printhead control flex-circuit 22. When the printhead control flex-circuit 22 couples a voltage across the first and second leads 50, 52, current will flow and begin to heat the ink heater 46. Since the PTC thermistor portion 48 is in a NTC region when first energized, heating causes the resistance of the PTC thermistor portion 48 to drop. The decreasing resistance, in turn, causes more current to flow which heats the part still further. If the voltage is high enough, the PTC thermistor portion 48 will self-heat until it passes into the PTC region of resistance. Once in the PTC region, the PTC thermistor portion 48 reaches a point where $I^2R$ heat generated by the part is sufficient to make up for the loss of heat to the environment. In this situation, the PTC thermistor portion 48 is in equilibrium. If it starts to decrease in temperature, the resistance will decrease, drawing more current and countering the cooling tendency. Conversely, any tendency to increase the temperature meets just the opposite effect. In this condition, the PTC thermistor portion 48 is automatically stabilized at a fixed temperature. Thus, the PTC thermistor 48 will maintain an operating temperature for a given voltage for ambient temperature below the set temperature of the PTC thermistor. The set or switching temperature is established by the PTC material and manufacturing process. The operating temperature can be changed by changing the voltage across the leads 50, 52.

In addition, since the first and second leads 50, 52 are on the same side (i.e., the lower side 66) of the PTC thermistor portion 48, $I^2R$ heating is generated between the first and second electrodes 76, 78 and on the lower side 66.

The particular configuration of the printhead 10 of the present invention provides further advantages. FIG. 4 shows that the ink channels 36 include ink channels 86 located near the center of the printhead 10, and ink channels 88 which are located near the side of the printhead 10. Because of the arrangement and location of the ink channels 36, certain of the ink channels will dissipate heat faster than the other channels. The present invention screens the first and second electrodes 76, 78 onto the PTC thermistor portion 48 in a pattern that thermally tunes the ink heater 46 to the specific application. The present invention takes advantage of the fact that the PTC thermistor portion 48 has a room temperature ($R_{25}$) resistance per lineal dimension. That is, the shorter the distance between the first and second electrodes 76, 78, the lower the resistance and the greater the current draw and heat applied in that area when power is applied. In most applications, the side ink channel 88 dissipate heat faster than the center ink channel 86 because the center ink channels 86 are adjacent other heated channels, whereas the side ink channel 88 are adjacent a portion of the printhead 10 which is exposed to the atmosphere. In addition, the closer the first and second electrodes 76, 78 are arranged the faster the ink heater 46 will reach equilibrium.

Figure 7D:
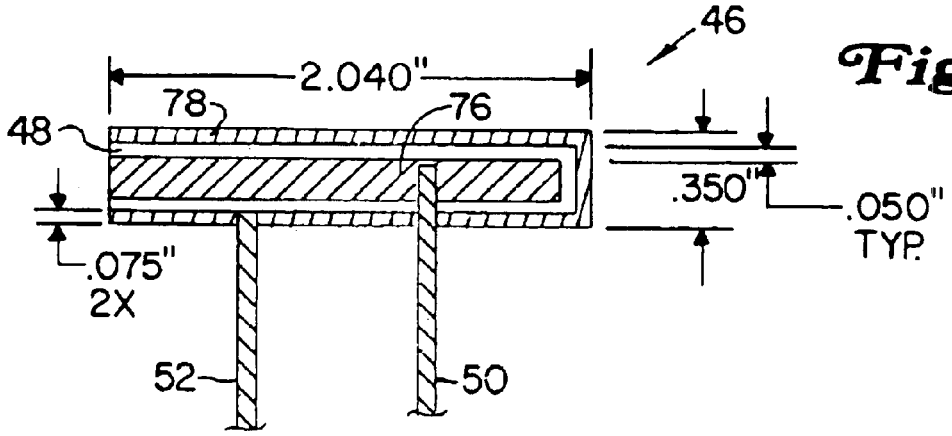
Figure 7E:
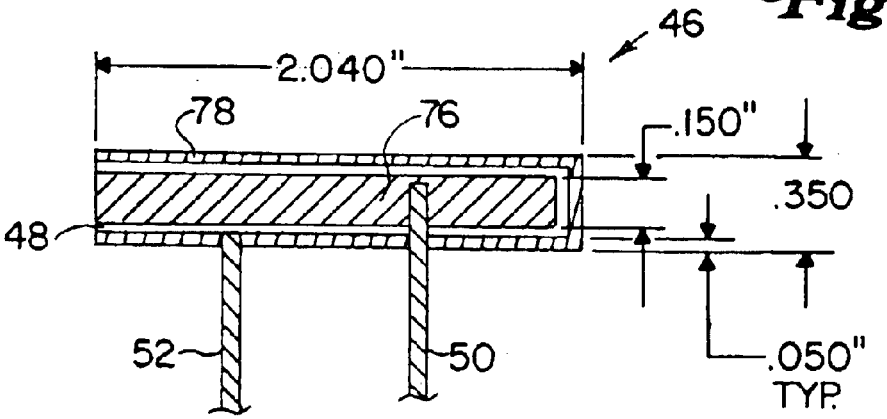
Figure 7F:
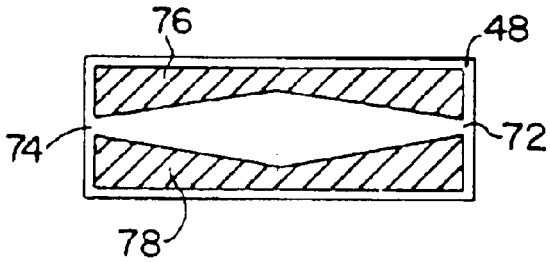
Figure 7G:
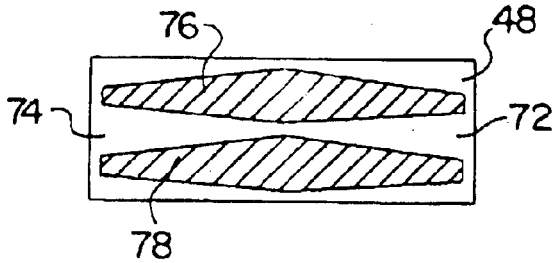
Figure 7H:
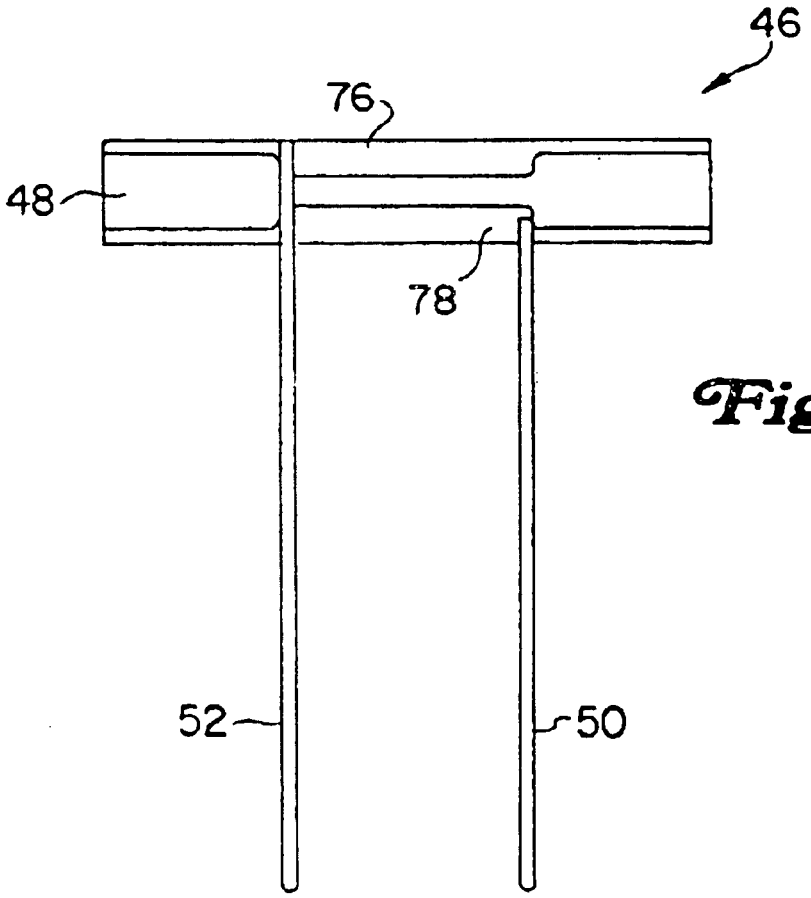

FIGS. 7A–7H disclose the PTC thermistor portion 48 with the first and second electrodes 76, 78 having various patterns in order to thermally tune the ink heater 46 to a specific application. FIGS. 7A–C disclose an electrode pattern wherein a constant temperature is generated across the PTC thermistor portion 48 between the first and second electrodes 76, 78. FIGS. 7D and 7E disclose an electrode pattern wherein heat is generated on the PTC thermistor portion 48 in a U-shaped pattern. FIG. 7F discloses an electrode pattern where more heat is generated in the center of the PTC thermistor portion 48 than along the first and second transverse edges 72, 74. Such an arrangement is effective wherein the center ink channels 86 dissipate more heat than the side ink channel 88. FIG. 7G and 7H disclose an electrode pattern where more heat is generated along the first and second transverse edges 72, 74 than at the center of the PTC thermistor portion 48. The pattern of FIGS. 7G and 7H are effective, for example, wherein the side ink channels 88 dissipate heat at a rate greater than the center ink channels 86.

While preferred embodiments of the present invention have been illustrated and described, it will be understood by those of ordinary skill in the art that changes and modifications can be made without departing from the invention in its broader aspects. Various features of the present invention are set forth in the following claims.

What is claimed is:

1. An ink jet print head, comprising:

a plurality of ink channels disposed in a common plane, each of said channels having at least one orifice for projecting ink towards a substrate; and an ink heater made of a thermistor material having a positive temperature coefficient, the ink heater having a substantially flat plate configuration with a planar surface both facing said ink channels and extending in a plane generally parallel to the common plane of the ink channels, said planar surface being disposed adjacent to the ink channels, wherein the thermistor material includes a first side and a second side, and the ink heater includes a first electrode and a second electrode located on the first side of the thermistor material, wherein heat is generated on the first side of the thermistor material between the first and second electrodes, and wherein the ink heater includes a first edge and a second edge, the first edge is located opposite from the second edge, the first and second edges extend in a direction which is substantially perpendicular to the plurality of ink channels, the first electrode extends along the first edge and the second electrode extends along the second edge, wherein the first and second electrodes are opposite from one another and substantially parallel.

2. The print head of claim 1, wherein the ink heater is made of a ceramic thermistor material.

3. The print head of claim 1, further comprising a first lead electrically coupled to the first electrode, and a second lead electrically coupled to the second electrode.

4. The print head of claim 3, further comprising:

a top body portion having a first plurality of ink channel grooves extending in a longitudinal direction;

an intermediate body portion having an upper side and a lower side, a second plurality of ink channel grooves extending in a longitudinal direction along the upper side, the upper side of the intermediate body portion located adjacent the top body portion wherein the first and second plurality of ink channel grooves form the plurality of ink channels;

a main body portion located adjacent the lower side of the intermediate body portion; and wherein the ink heater is located between the lower side of the intermediate body portion and the main body portion.

5. An ink iet print head, comprising:

a plurality of ink channels disposed in a common plane, each of said channels having at least one orifice for protecting ink towards a substrate; and an ink heater made of a thermistor material having a positive temperature coefficient, the ink heater having a substantially flat plate configuration with a planar surface both facing said ink channels and extending in a plane generally parallel to the common plane of the ink channels, said planar surface being disposed adjacent to the ink channels, wherein the thermistor material includes a first side and a second side, and the ink heater includes a first electrode and a second electrode located on the first side of the thermistor material, wherein heat is generated on the first side of the thermistor material between the first and second electrodes, and wherein the plurality of ink channels include one or more channels which dissipate heat at a higher rate than other channels, and the first and second electrodes are located in an arrangement so that the thermistor material generates greater heat in a first area located adjacent the one or more channels than a second area adjacent the other channels.

6. The print head of claim 5, wherein the ink heater include a first edge and a second edge, the first edge is located opposite from the second edge, the first and second edges extend in a direction which is substantially perpendicular to the plurality of ink channels, the first electrode extends along the first edge and the second electrode extends along the second edge, wherein the first and second electrodes are opposite from one another and substantially parallel.

7. The print head of claim 6, wherein the first electrode extends near a center portion of the thermistor material, and the second electrode extends near the center portion of the thermistor material, wherein the first and second electrodes are in close proximity to one another so as to minimize the time the ink heater reaches equilibrium.

8. The print head of claim 5, wherein the plurality of ink channels include outside channels and inside channels, and the first and second electrodes include a first end and a second end and a mid-portion, wherein the first and second ends are wider than the mid-portion, wherein greater heat is generated adjacent the outside channels than adjacent the inside channels.

9. The print head of claim 5, wherein the plurality of ink channels include outside channels and inside channels, the first and second electrodes include a first end and a second end and a mid-portion, wherein the first and second ends are narrower than the mid-portion, wherein greater heat is generated adjacent the inside channels than adjacent the outside channels.

10. An ink jet print head, comprising:

a plurality of ink channels disposed in a common plane, each of said channels having at least one orifice for projecting ink towards a substrate; and an ink heater made of a thermistor material having a positive temperature coefficient, the ink heater having a substantially flat plate configuration with a planar surface both facing said ink channels and extending in a plane generally parallel to the common plane of the ink channels, said planar surface being disposed adjacent to the ink channels;

wherein the thermistor material includes a first side and a second side, and the ink heater includes a first electrode and a second electrode located on the first side of the thermistor material, wherein heat is generated on the first side of the thermistor material between the first and second electrodes, and wherein the ink heater includes:

a first longitudinal edge, a second longitudinal edge, a first transverse edge, and a second transverse edge, the first longitudinal edge is located opposite from the second longitudinal edge, the first and second longitudinal edges extend in a direction which is substantially perpendicular to the plurality of ink channels, the first transverse edge is located opposite from the second transverse edge, the first and second transverse edges extend in a direction which is substantially parallel to the plurality of ink channels, the second electrode is substantially U-shaped and extends along the first and second longitudinal edges and the first transverse edge, and the first electrode extends in an area defined by the U-shaped second electrode and in a direction parallel to the first and second longitudinal edges.

11. An ink jet print head, comprising:

a plurality of ink channels disposed in a common plane, each of said channels having at least one orifice for projecting ink towards a substrate; and an ink heater made of a thermistor material, the ink heater having a substantially flat plate configuration with a planar surface both facing said ink channels and extending in a plane generally parallel to the common plane of the ink channels, said planar surface being disposed adjacent to the ink channels;

wherein the ink heater is made of a thermistor material having a positive temperature coefficient, and wherein the thermistor material includes a first side and a second side, and the ink heater includes a first electrode and a second electrode located on the first side of the thermistor material, wherein heat is generated on the first side of the thermistor material between the first and second electrodes, a first lead electrically coupled to the first electrode, and a second lead electrically coupled to the second electrode;

a top body portion having a first plurality of ink channel grooves extending in a longitudinal direction;

an intermediate body portion having an upper side and a lower side, a second plurality of ink channel grooves extending in a longitudinal direction along the upper side, the upper side of the intermediate body portion located adjacent the top body portion wherein the first and second plurality of ink channel grooves form the plurality of ink channels;

a main body portion located adjacent the lower side of the intermediate body portion, wherein the ink heater is located between the lower side of the intermediate body portion and the main body portion, and wherein the main body portion includes a recess and first and second grooves extending in a longitudinal direction from the recess, wherein the recess receives the thermistor material and the first and second grooves receive the first and second leads, respectively.

12. The print head of claim 11, wherein the thermistor material is secured to the intermediate body portion with thermally conductive adhesive, and an insulating air gap is formed in the recess between the thermistor material and the main body portion.

13. The print head of claim 12, further comprising a print head controller electrically coupled to the ink heater, wherein a voltage potential is applied across the first and second leads.

14. The print head of claim 11, wherein the thermistor material is secured to the intermediate body portion with thermally conductive adhesive.

15. An ink jet print head comprising:

a top body portion;

an intermediate body portion having an upper side and a lower side, a plurality of ink channels disposed in a common plane along the upper side, each of said channels having at least one orifice for projecting ink towards a substrate, the upper side of the intermediate body portion located adjacent the top body portion;

a main body portion located adjacent the lower side of the intermediate body portion; and an ink heater made of a thermistor material having a positive temperature coefficient, the ink heater having a substantially planar configuration and is located between the lower side of the intermediate body portion and the main body portion, and extends in a plane generally parallel to the plane of the ink channels and adjacent to the ink channels, wherein the thermistor material includes a first side and a second side, and the ink heater includes a first electrode and a second electrode located on the first side of the thermistor material, wherein heat is generated on the first side of the thermistor material between the first and second electrodes, and wherein the plurality of ink channels include one or more channels which dissipate heat at a higher rate than other channels, and the first and second electrodes are located in an arrangement so that the thermistor material generates greater heat in a first area located adjacent the one or more channels than a second area adjacent the other channels.

16. The print head of claim 15, wherein the ink heater is made of a ceramic thermistor material.

17. The print head of claim 15, wherein the plurality of ink channels include outside channels and inside channels, and the first and second electrodes include a first end and a second end and a mid-portion, wherein the first and second ends are wider than the mid-portion, wherein greater heat is generated adjacent the outside channels than adjacent the inside channels.

18. The print head of claim 15, wherein the plurality of ink channels include outside channels and inside channels, the first and second electrodes include a first end and a second end and a mid-portion, wherein the first and second ends are narrower than the mid-portion, wherein greater heat is generated adjacent the inside channels than adjacent the outside channels.

19. An ink jet print head comprising:

a top body portion;

an intermediate body portion having an upper side and a lower side, a plurality of ink channels disposed in a common plane along the upper side, each of said channels having at least one orifice for projecting ink towards a substrate, the upper side of the intermediate body portion located adjacent the top body portion;

a main body portion located adjacent the lower side of the intermediate body portion; and an ink heater made of a thermistor material having a positive temperature coefficient, the ink heater having a substantially planar configuration and is located between the lower side of the intermediate body portion and the main body portion, and extends in a plane generally parallel to the plane of the ink channels and adjacent to the ink channels, wherein the thermistor material includes a first side and a second side, and the ink heater includes a first electrode and a second electrode located on the first side of the thermistor material, wherein heat is generated on the first side of the thermistor material between the first and second electrodes, and wherein the ink heater include a first edge and a second edge, the first edge is located opposite from the second edge, the first and second edge extend in a direction which is substantially perpendicular to the plurality of ink channels, the first electrode extends along the first edge and the second electrode extends along the second edge, wherein the first and second electrodes are opposite from one another and substantially parallel.

20. An ink jet print head comprising:

a top body portion:

an intermediate body portion having an upper side and a lower side, a plurality of ink channels disposed in a common plane along the upper side, each of said channels having at least one orifice for projecting ink towards a substrate, the upper side of the intermediate body portion located adjacent the top body portion;

a main body portion located adjacent the lower side of the intermediate body portion; and an ink heater made of a thermistor material, the ink heater having a substantially planar configuration and is located between the lower side of the intermediate body portion and the main body portion, and extends in a plane generally parallel to the plane of the ink channels and adjacent to the ink channels, wherein the ink heater is made of a thermistor material having a positive temperature coefficient, and wherein the thermistor material includes a first side and a second side, and the ink heater includes a first electrode and a second electrode located on the first side of the thermistor material, wherein heat is generated on the first side of the thermistor material between the first and second electrodes, and wherein the ink heater includes:

a first longitudinal edge, a second longitudinal edge, a first transverse edge and a second transverse edge, the first longitudinal edge is located opposite from the second longitudinal edge, the first and second longitudinal edges extend in a direction which is substantially perpendicular to the plurality of ink channels, the first transverse edge is located opposite from the second transverse edge, the first and second transverse edges extend in a direction which is substantially parallel to the plurality of ink channels, and the first electrode is substantially U-shaped and extends along the first and second longitudinal edges and the first transverse edge, and the second electrode extends in an area defined by the U-shaped first electrode and in a direction parallel to the first and second longitudinal edges.

21. An ink jet print head comprising:

a top body portion;

an intermediate body portion having an upper side and a lower side, a plurality of ink channels disposed in a common plane along the upper side, each of said channels having at least one orifice for projecting ink towards a substrate, the upper side of the intermediate body portion located adjacent the top body portion;

a main body portion located adjacent the lower side of the intermediate body portion; and an ink heater made of a thermistor material, the ink heater having a substantially planar configuration and is located between the lower side of the intermediate body portion and the main body portion, and extends in a plane generally parallel to the plane of the ink channels and adjacent to the ink channels, wherein the main body portion includes a recess and first and second grooves extending in a longitudinal direction from the recess, wherein the recess receives the thermistor material and the first and second grooves receive the first and second leads, respectively.

22. The print head of claim 21, wherein the ink heater is made of a thermistor material having a positive temperature coefficient.

23. The print head of claim 21, wherein the thermistor material includes a first side and a second side, and the ink heater includes a first electrode and a second electrode located on the first side of the thermistor material, wherein heat is generated on the first side of the thermistor material between the first and second electrodes.

24. The print head of claim 23, further comprising a first lead electrically coupled to the first electrode, and a second lead electrically coupled to the second electrode.

25. The print head of claim 23, wherein the plurality of ink channels include one or more channels which dissipate heat at a higher rate than other channels, and the first and second electrodes are located in an arrangement so that the thermistor material generates greater heat in a first area located adjacent the one or more channels than a second area adjacent the other channels.

26. The print head of claim 21, wherein the thermistor material is secured to the intermediate body portion with thermally conductive adhesive, and an insulating air gap is formed in the recess between the thermistor material and the main body portion.

27. The print head of claim 26, further comprising a circuit electrically coupled to the ink heater, wherein a voltage potential is applied across the first and second leads.

28. The print head of claim 21, wherein the thermistor material is secured to the intermediate body portion with thermally conductive adhesive.

* * * * *

UNITED STATES PATENT AND TRADEMARK OFFICE

CERTIFICATE OF CORRECTION

PATENT NO. : 6,802,585 B1
DATED : October 12, 2004
INVENTOR(S) : Philip D. Wratchford It is certified that error appears in the above-identified patent and that said Letters Patent is hereby corrected as shown below:

Title page,
Item [73], Assignee, delete "Videojet Systems International, Inc." and insert therefor -- Marconi Data Systems Inc. --

Signed and Sealed this

Twenty-fourth Day of May, 2005

JON W. DUDAS
*Director of the United States Patent and Trademark Office*